US010012397B2

(12) United States Patent
Okamoto et al.

(10) Patent No.: US 10,012,397 B2
(45) Date of Patent: Jul. 3, 2018

(54) INDOOR UNIT

(71) Applicant: DAIKIN INDUSTRIES, LTD., Osaka-Shi, Osaka (JP)

(72) Inventors: Naoko Okamoto, Kusatsu (JP); Junichi Nakanishi, Kusatsu (JP); Toshiaki Yamada, Kusatsu (JP); Katsuhiro Wakihara, Kusatsu (JP); Tetsuji Inoue, Kusatsu (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 57 days.

(21) Appl. No.: 15/039,619

(22) PCT Filed: Oct. 27, 2014

(86) PCT No.: PCT/JP2014/078517
§ 371 (c)(1),
(2) Date: May 26, 2016

(87) PCT Pub. No.: WO2015/079848
PCT Pub. Date: Jun. 4, 2015

(65) Prior Publication Data

US 2017/0254547 A1 Sep. 7, 2017

(30) Foreign Application Priority Data

Nov. 26, 2013 (JP) ..... 2013-244420

(51) Int. Cl.
*F24F 1/00* (2011.01)
*F24F 13/12* (2006.01)
*F24F 13/20* (2006.01)

(52) U.S. Cl.
CPC ..... *F24F 1/0011* (2013.01); *F24F 1/0025* (2013.01); *F24F 13/12* (2013.01); *F24F 13/20* (2013.01); *F24F 2001/0048* (2013.01)

(58) Field of Classification Search
CPC ..... F24F 1/0011; F24F 1/0025; F24F 13/12; F24F 13/20; F24F 2001/0048
(Continued)

(56) References Cited

U.S. PATENT DOCUMENTS 6,141,983 A 11/2000 Nishikawa et al.
2006/0218957 A1 10/2006 Nakamura
2008/0047288 A1* 2/2008 Nakamura ..... F24F 1/0007 62/262

FOREIGN PATENT DOCUMENTS

EP 1 752 713 A1 2/2007
JP 7-63368 A 3/1995
(Continued)

OTHER PUBLICATIONS

Extended European Search Report of EP 14866745.4 dated Nov. 28, 2016.

*Primary Examiner* — Gregory Huson
*Assistant Examiner* — Dana Tighe
(74) *Attorney, Agent, or Firm* — Birch, Stewart, Kolasch & Birch, LLP

(57) ABSTRACT

When a front panel moves away from a front surface of a casing, a central part of the front panel is warped. An indoor unit of the present invention includes a casing, a front panel provided forward of the casing, and a drive mechanism moving the front panel away from the front surface of the casing. The front panel is curved so that its central part protrudes forward. The drive mechanism moves the front panel in a substantially horizontal direction.

2 Claims, 16 Drawing Sheets

(58) Field of Classification Search
USPC ..... 454/228, 234, 233; 62/263
See application file for complete search history.

(56) References Cited

FOREIGN PATENT DOCUMENTS

| | | | | | |
|---|---|---|---|---|---|
| JP | 11-201486 | A | | 7/1999 | |
| JP | 2000130796 | | * | 12/2000 | ..... F24F 1/00 |
| JP | 2002-295888 | A | | 10/2002 | |
| JP | 2003-148761 | A | | 5/2003 | |
| JP | 2005-98671 | A | | 4/2005 | |
| JP | 2006-145106 | A | | 6/2006 | |
| JP | 2011-149620 | A | | 8/2011 | |

* cited by examiner

DURING STOP

DURING OPERATION

FIG.3A DURING STOP
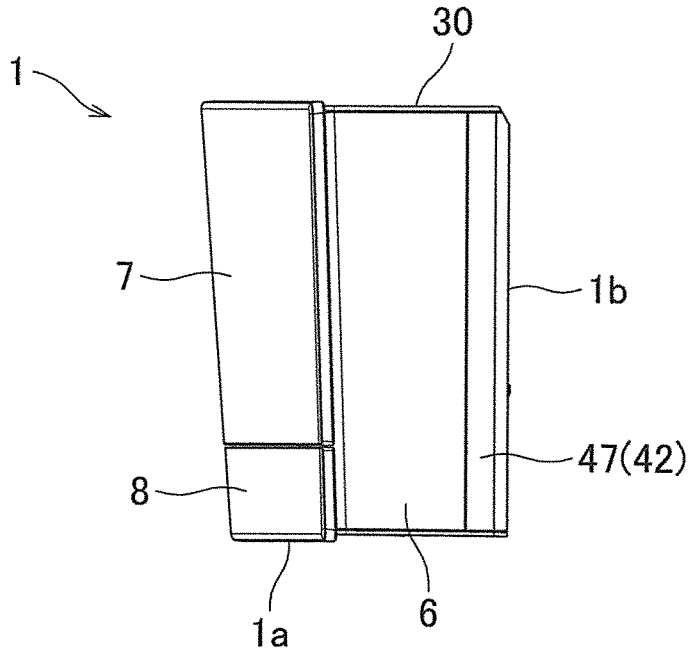
FIG.3B DURING OPERATION
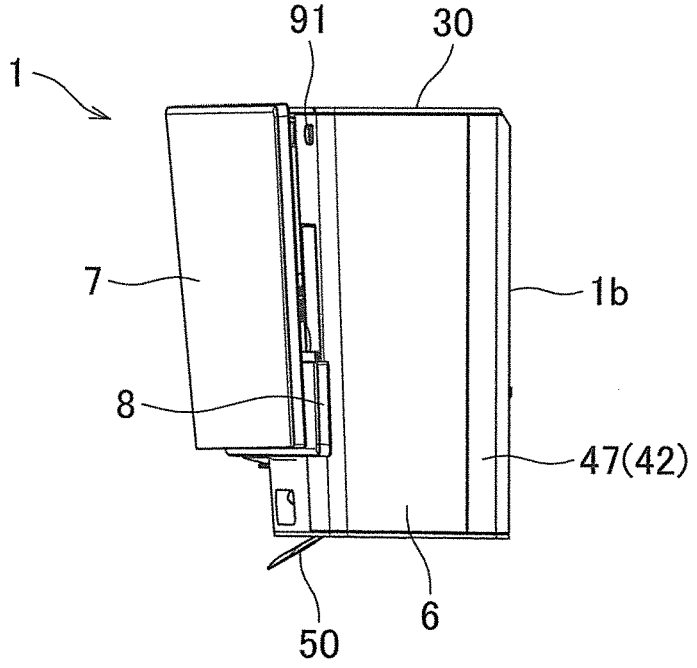

FIG.7A DURING STOP
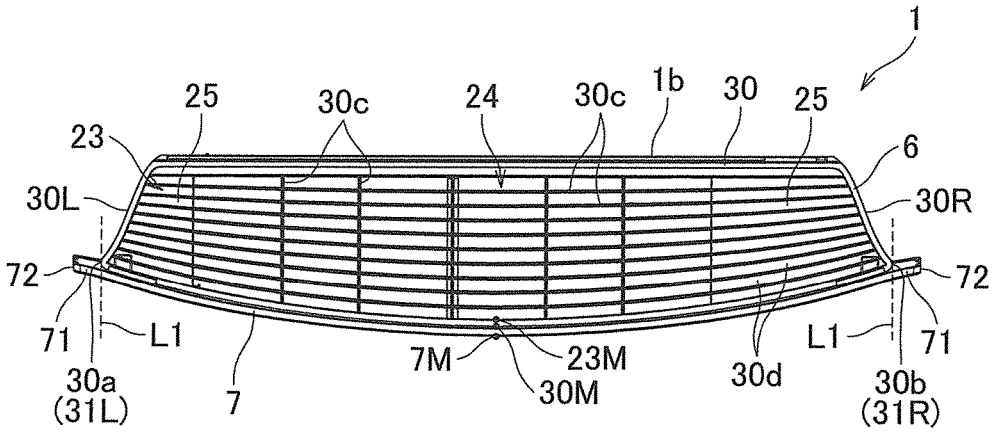
FIG.7B DURING OPERATION
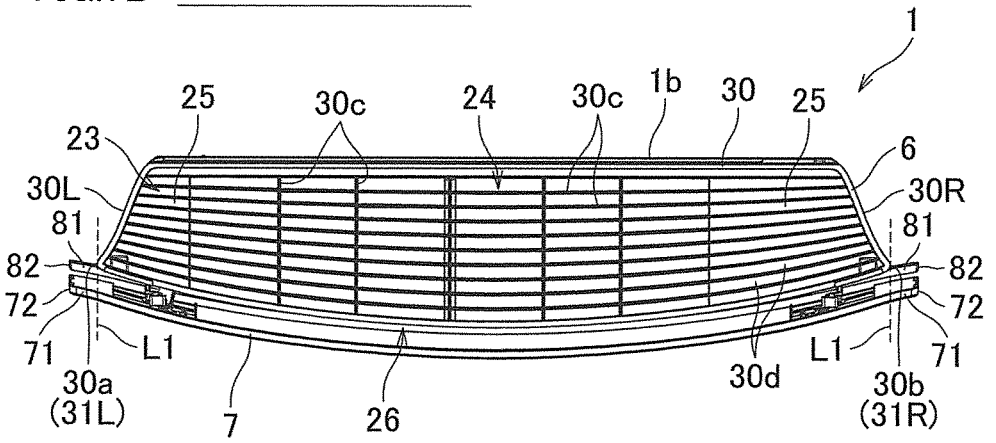

FIG.12A PART A
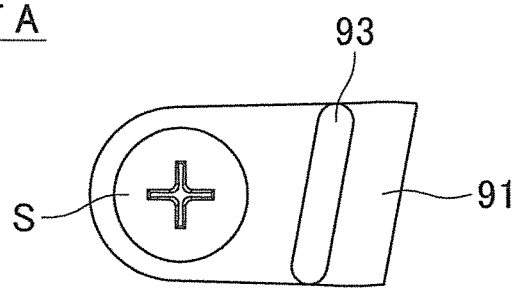
FIG.12B
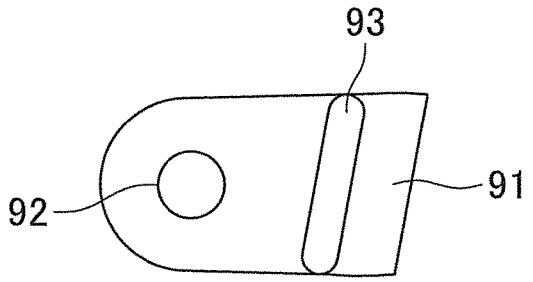
FIG.12C
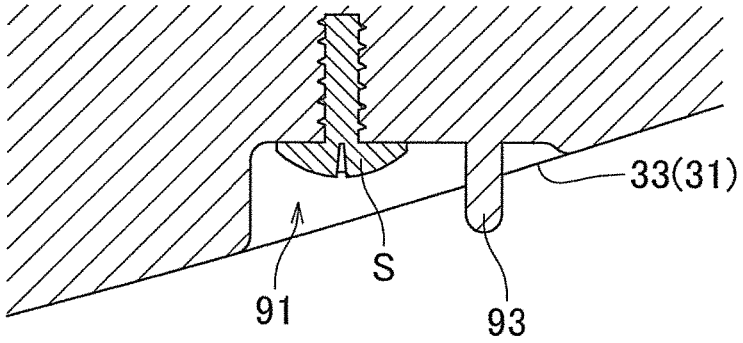

INDOOR UNIT

TECHNICAL FIELD

The present invention relates to an indoor unit used in, for example, an air conditioner.

BACKGROUND ART

A known indoor unit is provided with a casing and a front panel arranged forward of the casing to be movable relative to the casing. This indoor unit includes an inlet port formed through a top plate portion of the casing and a cross flow fan provided in the casing.

In this indoor unit, the front panel is disposed to be substantially along the vertical direction during operation stop and is disposed to be significantly inclined during operation as the upper end of the front panel is moved to a position forward of the lower end.

With this arrangement, during operation, air sucked through the inlet port of the top plate portion and a gap between the front panel and the casing is supplied to the cross flow fan, and the air from the cross flow fan is then blown out from the outlet port.

CITATION LIST

Patent Literatures

[Patent Literature 1] Japanese Unexamined Patent Publication No. 2011-149620

SUMMARY OF INVENTION

Technical Problem

A known indoor unit typically employs a front panel made of resin.

In regard to the outer periphery of the front panel, warping is restrained by improving the strength by means of a reinforcing rib provided on the back surface of the front panel. In the meanwhile, in regard to the central part of the front panel, warping cannot be restrained by the reinforcing rib because a part of the front surface of the front panel corresponding to the reinforcing rib on the back surface is dented during resin molding and the appearance of the front panel is spoiled.

When, during operation, such a front panel is arranged to be significantly inclined as compared to the operation stop, the downward force acting on the central part of the front panel is increased as compared to the operation stop, with the result that the central part of the front panel is disadvantageously warped during operation.

An object of the present invention is to provide an indoor unit in which warping of a central part of a front panel is restrained when the front panel moves away from the front surface of a casing.

Solution to Problem

According to the first aspect of the invention, an indoor unit includes: a casing; a front panel provided forward of the casing; and a drive mechanism configured to move the front panel away from a front surface of the casing, the front panel being curved so that a central part of the front panel protrudes forward, and the drive mechanism moving the front panel in a substantially horizontal direction.

In this indoor unit, the front panel merely moves in the substantially horizontal direction and the inclination of the front panel does not become great. For this reason, even if the front panel moves away from the front surface of the casing, the downward force acting on the central part of the front panel does not increase as compared to the downward force during operation stop, and hence the warping of the central part of the front panel is restrained.

According to the second aspect of the invention, the indoor unit of the first aspect is arranged such that the casing includes an outlet port provided below the front panel, an outlet panel is provided below the front panel and forward of the inlet port, and the drive mechanism moves the outlet panel to a gap between the front panel and the casing in a state that the front panel has been moved forward.

In this indoor unit, because the outlet panel is moved to the gap between the front panel and the casing in the state that the front panel has moved forward, it is possible to close the gap between the lower end portion of the front panel and the casing. This restrains the air blown out from the outlet port from being sucked into the gap between the front panel and the casing.

According to the third aspect, the indoor unit of the first or second aspect is arranged such that the front panel is inclined toward a back surface in a direction to a lower end.

In this indoor unit, as the front panel is inclined to the back surface side toward the lower end, the thickness of the bottom surface part of the indoor unit is thinner than the thickness of the top plate portion of the indoor unit, and hence the indoor unit looks thin when a user sees the indoor unit from below.

According to the fourth aspect of the invention, the indoor unit of any one of the first to third aspects is arranged such that the casing includes a top plate portion where the inlet port is formed and houses a cross flow fan, the top plate portion is curved so that a central part of a front end of the top plate portion protrudes forward, and the width of an inlet central part of the inlet port corresponding to the central part of the front end of the top plate portion is wider than the width of each of ends in a longitudinal direction of the inlet port.

In this indoor unit, because the width of the inlet central part of the inlet port is wider than the width of each of the ends in the longitudinal direction of the inlet port, air volume is increased at around the central part of the cross flow fan.

Advantageous Effects of Invention

As described hereinabove, the present invention brings about the following effects.

According to the first aspect of the invention, the front panel merely moves in the substantially horizontal direction and the inclination of the front panel does not become great. For this reason, even if the front panel moves away from the front surface of the casing, the downward force acting on the central part of the front panel does not increase as compared to the downward force during operation stop, and hence the warping of the central part of the front panel is restrained.

According to the second aspect of the invention, because the outlet panel is moved to the gap between the front panel and the casing in the state that the front panel has moved forward, it is possible to close the gap between the lower end portion of the front panel and the casing. This restrains the air blown out from the outlet port from being sucked into the gap between the front panel and the casing.

According to the third aspect of the invention, as the front panel is inclined to the back surface side toward the lower end, the thickness of the bottom surface part of the indoor unit is thinner than the thickness of the top plate portion of the indoor unit, and hence the indoor unit looks thin when a user sees the indoor unit from below.

According to the fourth aspect of the invention, because the width of the inlet central part of the inlet port is wider than the width of each of the ends in the longitudinal direction of the inlet port, air volume is increased at around the central part of the cross flow fan.

BRIEF DESCRIPTION OF DRAWINGS

FIG. 2A is a front elevation of the indoor unit during operation stop, whereas

FIG. 3A is a right side view of the indoor unit during operation stop, whereas FIG. 3B is a right side view of the indoor unit during operation.

FIG. 7A is a top view of the indoor unit during operation stop, whereas FIG. 7B is a top view of the indoor unit during operation.

FIG. 12A is an enlarged view of a part A in FIG. 4, FIG. 12B shows a state in which a screw has been removed as compared to the state shown in FIG. 12A, and FIG. 12C is a cross section taken at the XII(c)-XII(c) line in FIG. 4.

FIG. 16A shows a state before the movement of the front panel, FIG. 16B shows a state after the movement of the front panel, and FIG. 16C shows a state after the movement of the front panel and the outlet panel.

DESCRIPTION OF EMBODIMENTS

The following will describe an indoor unit of an air conditioner of an embodiment of the present invention.

[Overall Structure of Air Conditioner]

The air conditioner of the embodiment of the present invention is formed of an indoor unit 1 shown in FIG. 1 and an unillustrated outdoor unit. The indoor unit 1 is on the whole narrow in shape in one direction, and is attached to a wall surface of a room so that the length thereof is horizontal. Hereinafter, a direction of protrusion from the wall surface on which the indoor unit 1 is provided will be referred to as "forward", and a direction opposite to the forward will be referred to as "backward". Furthermore, a left-right direction shown in FIG. 1 will be simply referred to as "left-right direction", and an up-down direction shown in FIG. 1 will be simply referred to as "up-down direction".

[Structure of Indoor Unit]

Figure 5:
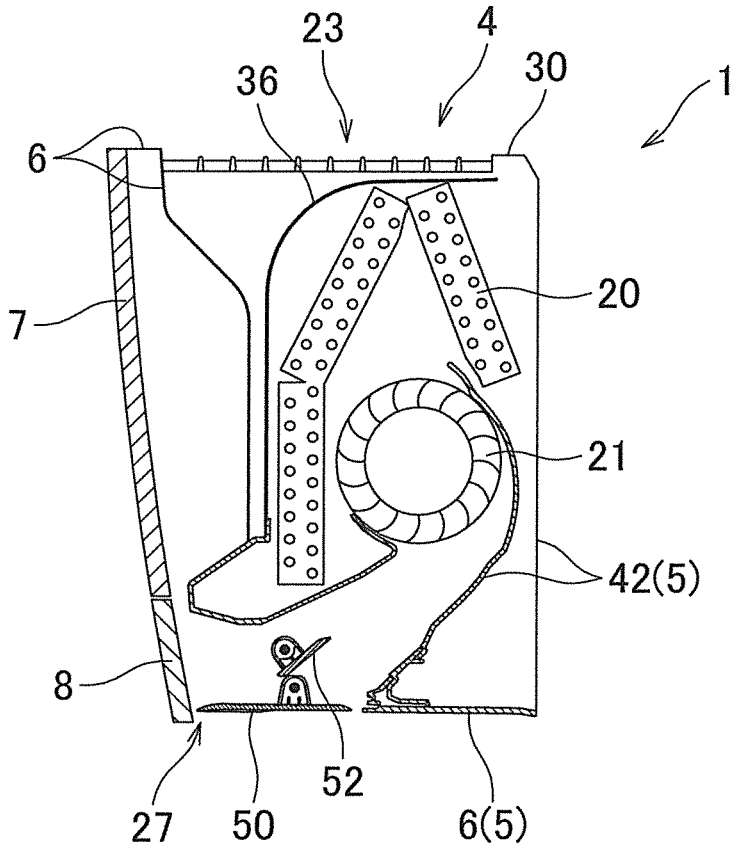
FIG. 5 schematically shows a vertical cross section of the indoor unit.

As shown in FIG. 5, the indoor unit 1 is mainly provided with a main body 4, a front panel 7, an outlet panel 8, a wind direction changing plate 50, and the like.

[Main Body]

Figure 4:
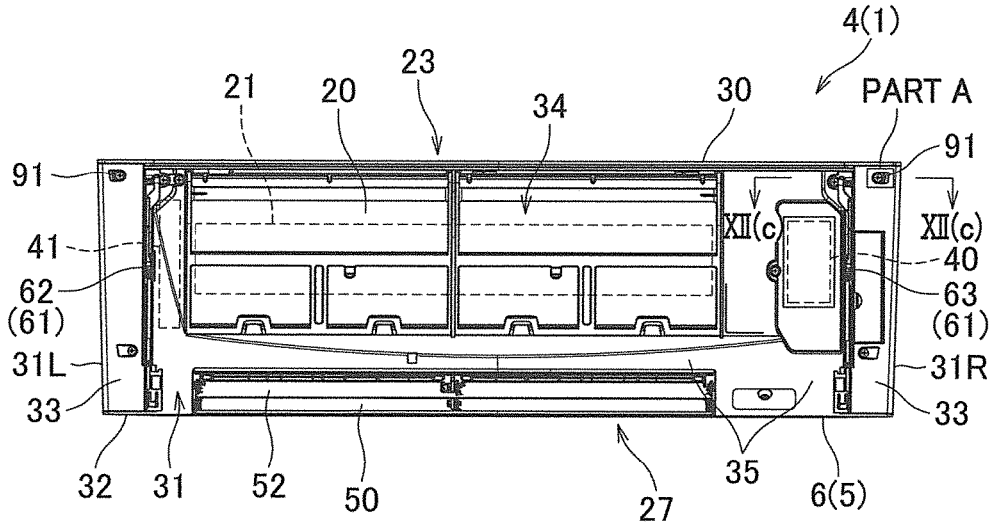
FIG. 4 is a front elevation of the indoor unit from which the front panel and the outlet panel have been detached.

As shown in FIG. 4 and FIG. 5, the main body 4 includes a casing 5 including a bottom frame 42 and a front grill 6, an indoor heat exchanger 20 housed in the casing 5, a cross flow fan 21 (hereinafter, this may be simply referred to as a fan 21), a fan motor 22 (see FIG. 6), and an electric component box 40.

As shown in FIG. 5, the indoor heat exchanger 20 and the fan 21 are attached to the bottom frame 42. The indoor heat exchanger 20 and the fan 21 are arranged such that the fan 21 is provided at a substantial center of the indoor unit 1 in cross section and the indoor heat exchanger 20 which is inverse V-shaped is provided to surround an upper half of the fan 21.

Figure 6:
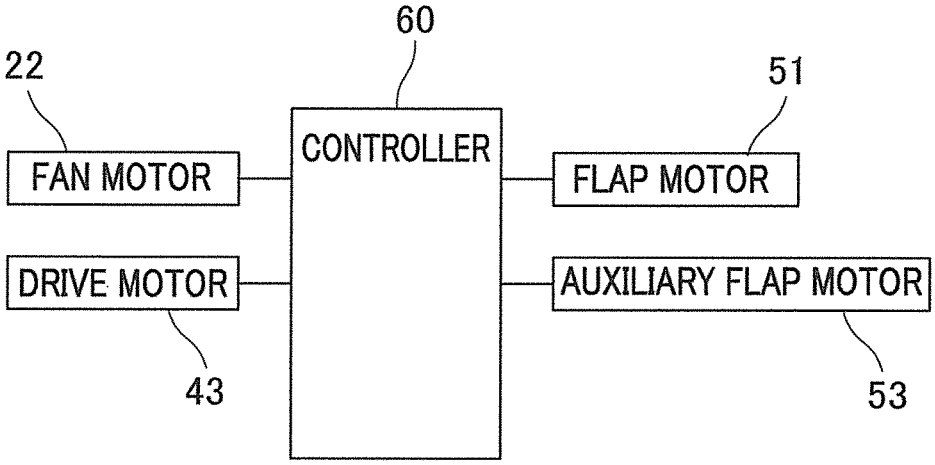
FIG. 6 is a block diagram of a controller of the indoor unit.

As shown in FIG. 4, the electric component box 40 is provided to the right of the indoor heat exchanger 20 and the fan 21 in front elevation. The electric component box 40 houses a controller 60 therein (see FIG. 6) for controlling components of the indoor unit 1 required for operations such as cooling and warming. As shown in FIG. 6, this controller 60 is connected with the fan motor 22 driving the fan 21, a drive motor 43 driving a driver 41 of a later-described drive mechanism 9, a flap motor driving the wind direction changing plate 50, and an auxiliary flap motor 53 driving a later-described auxiliary wind direction changing plate 52, to control the fan 21, the driver 41, the wind direction changing plate 50, and the auxiliary wind direction changing plate 52.

The bottom frame 42 is made of a resin material and is shaped to cover the bottom, back, and the sides of the fan 21. This bottom frame 42 includes: an unillustrated main casing which fixes the indoor heat exchanger 20 and the fan 21 and constitutes a back surface 1*b* of the indoor unit 1; and decorative plates 47 (see FIG. 3) constituting, together with the front grill 6, side surfaces of the indoor unit 1. On the back surface of the main casing, a mounting board is attached to fix the indoor unit 1 to the wall surface of the room.

Figure 2A:
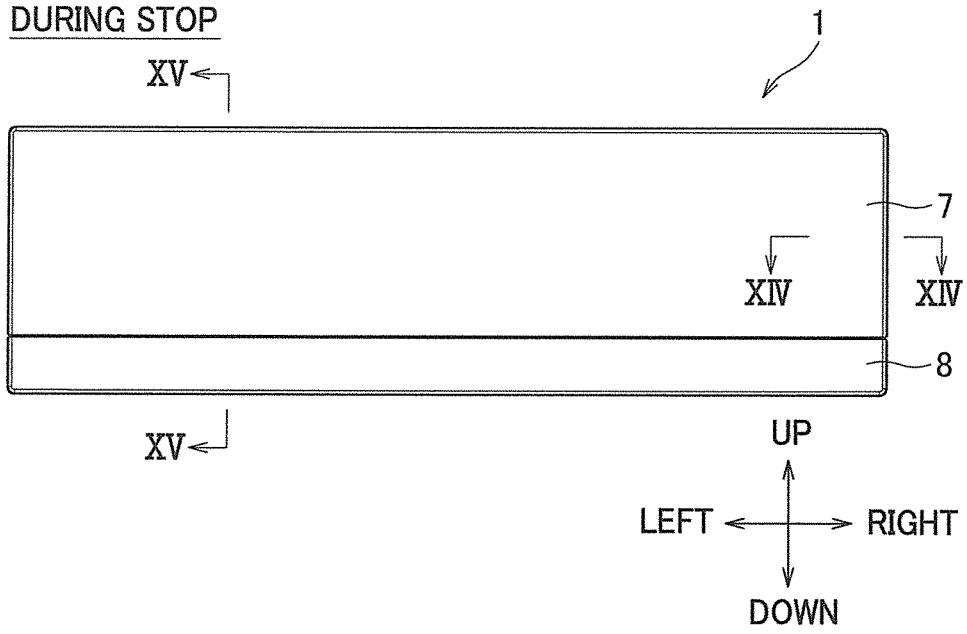
Figure 2B:
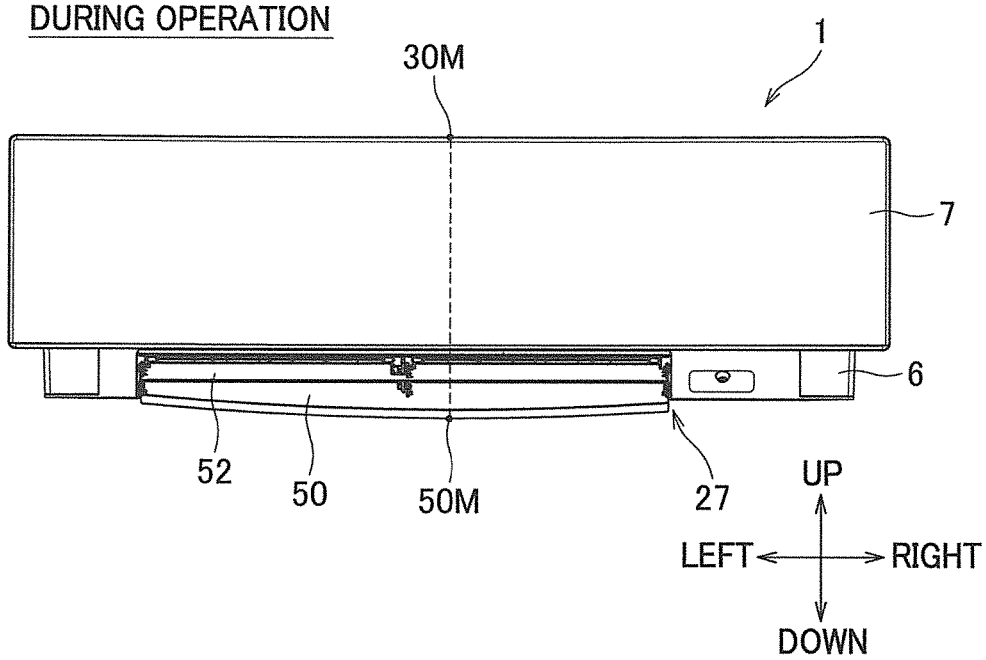
FIG. 2B is a front elevation of the indoor unit during operation.

A lower part of the bottom frame 42 and the front grill 6 form an outlet port 27. This outlet port 27 is a port through which wind from the fan 21 is blown into the room. The outlet port 27 is provided in the vicinity of a lower part of the indoor unit 1 and is on the front surface side of the indoor unit 1. As shown in FIG. 2B the outlet port 27 is shaped to be long in a horizontal direction in front elevation.

[Front Grill]

The front grill 6 is attached to the bottom frame 42 from the front side, and covers the front, sides, top, and bottom of the main body 4. The front grill 6 is formed by molding a resin material, is thin and rectangular parallelepiped in shape, and is entirely open at the back. As shown in FIG. 4, this front grill 6 includes a top plate portion 30, a front surface 31 (the front surface of the casing), and a bottom surface 32.

(Top Plate Portion)

Figure 9A:
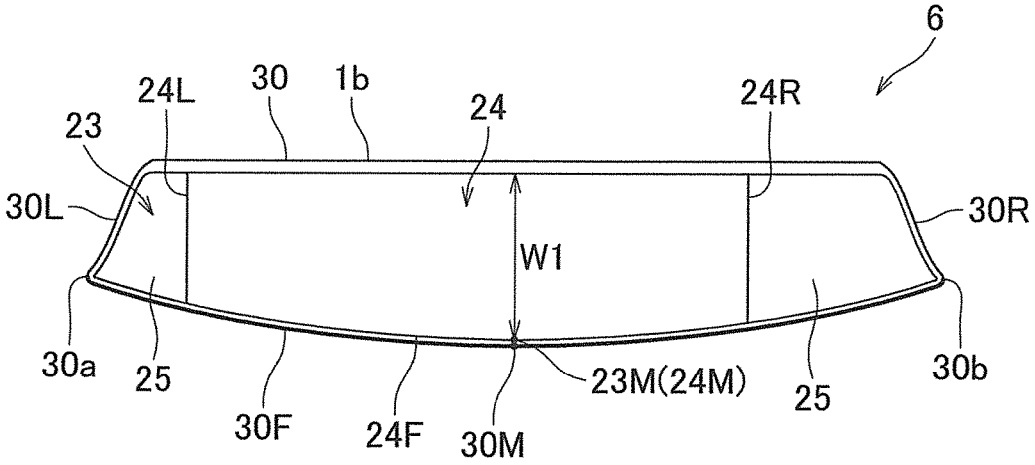
FIG. 9A schematically shows the top plate portion.

As shown in FIG. 9A, the top plate portion 30 is curved so that a central part 30M of a front end 30F protrudes forward. To be more specific, the front end 30F of the top plate portion 30 is inclined to the back surface 1*b* side from the central part 30M of the front end 30F toward the both ends 30*a* and 30*b* of the front end 30F, and is curved so that the direction of a tangent to the front end 30F of the top plate portion 30 continuously changes in plan view. Side ends 30L and 30R of the top plate portion 30 are inclined (curved) to the center in the longitudinal direction (left-right direction) of the indoor unit 1 from the ends 30*a* and 30*b* toward the back surface 1*b*.

The substantially entirety of the top plate portion 30 functions as a first inlet port 23 (inlet port) for sucking air inside the room. As shown in FIG. 7A, across the substantially entire first inlet port 23, blades 30*c* are provided to extend in the longitudinal direction and the front-back direction. Below this first inlet port 23 (i.e., on the inner side of the indoor unit 1), an opening 24 is formed at the central part in the longitudinal direction and non-openings 25 are formed outside in the longitudinal direction of the opening 24. In an area corresponding to the opening 24, a gap between the blades 30*c* is open. In an area corresponding to each non-opening 25, a plate 30*d* is provided to close gaps between the blades 30*c*. This plate 30*d* is provided below the outer edge of the top plate portion 30 (i.e., provided on the inner side of the indoor unit 1 as compared to the first inlet port 23). With this arrangement, room air sucked through the first inlet port 23 is either directly taken into the fan 21 side through the opening 24 or horizontally flows on the plates 30*d* of the non-openings 25 and is then taken into the fan 21 side through the opening 24.

As shown in FIG. 9A, the first inlet port 23 is arranged such that the width W1 of an inlet central part 23M corresponding to the central part 30M of the front end 30F of the top plate portion 30 in the longitudinal direction is wider than the width of each of the both ends in the longitudinal direction of the first inlet port 23. In other words, in the present embodiment, the width W1 is arranged to be wider than each of the width around the left end 30*a* of the top plate portion 30 and the width around the right end 30*b* of the top plate portion 30. In the present embodiment, the width around the left end 30*a* of the top plate portion 30 and the width around the right end 30*b* of the top plate portion 30 are very narrow (almost zero). The width of the first inlet port 23 is maximum at the inlet central part 23M. The width of the first inlet port 23 is narrowed from the inlet central part 23M toward the ends 30*a* and 30*b* in the longitudinal direction. For the sake of convenience, FIG. 9A does not show the blades 30*c* extending in the longitudinal direction and the front-back direction.

Figure 10:
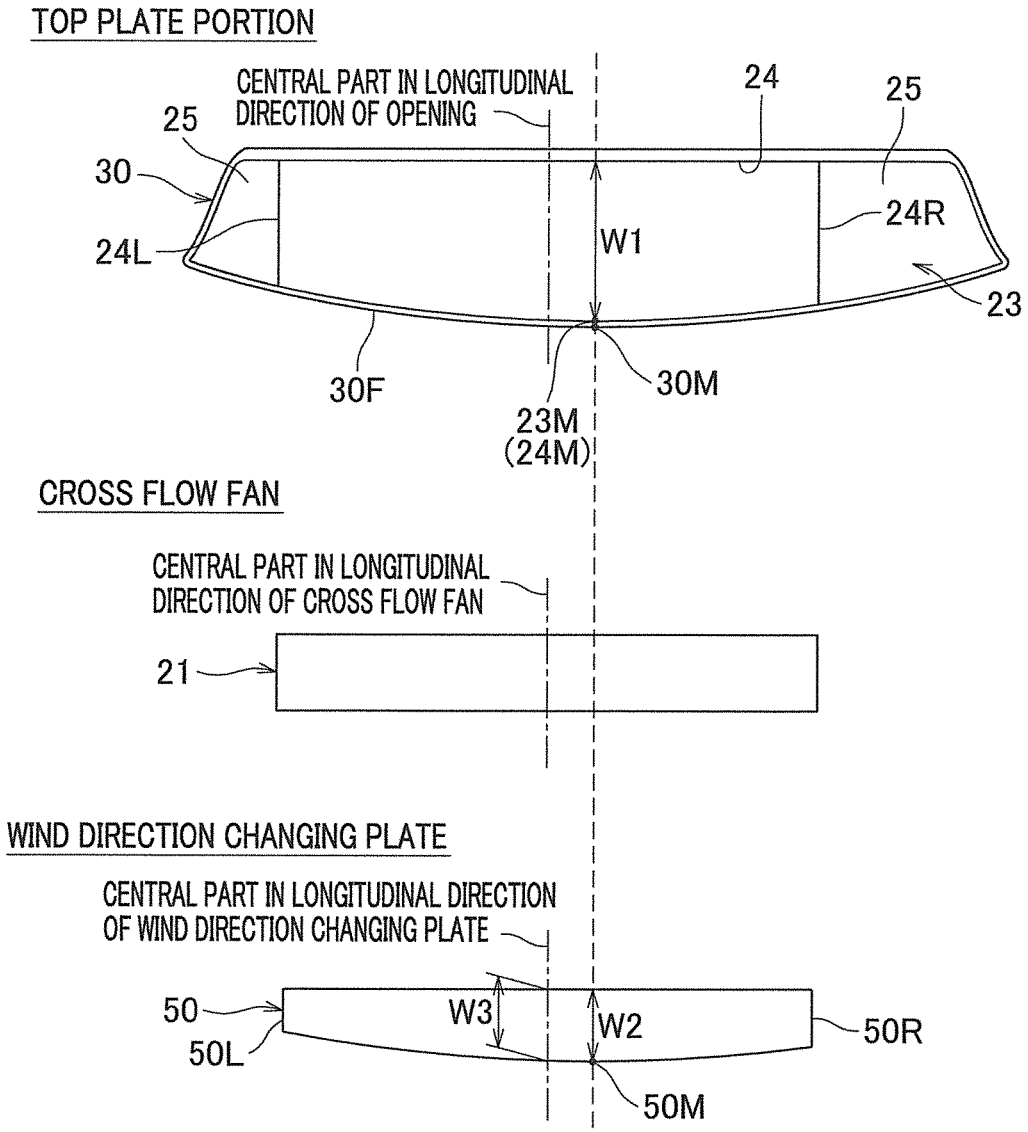
FIG. 10 illustrates the positional relationship between the top plate portion, the cross flow fan, and the wind direction changing plate.

As shown in FIG. 9A, the front end 24F of the opening 24 extends along the front end 30F of the top plate portion 30. The opening 24 is arranged such that the width of an opening central part 24M corresponding to the central part 30M of the front end 30F of the top plate portion 30 in the longitudinal direction is wider than the width of each of the both ends of the opening 24 (i.e., wider than each of the width of the left end 24L of the opening 24 and the width of the right end 24R of the opening 24). As shown in FIG. 10, the central part in the longitudinal direction of the opening 24 below the top plate portion 30 is slightly shifted leftward from the inlet central part 23M corresponding to the central part 30M of the front end 30F of the top plate portion 30 and corresponds to the central part in the longitudinal direction of the fan 21 and the central part in the longitudinal direction of the wind direction changing plate 50. Furthermore, the ends 24L and 24R of the opening 24 substantially correspond to the ends of the fan 21 and the ends 50L and 50R of the wind direction changing plate 50.

(Front Surface)

As shown in FIG. 4, the front surface 31 (the front surface of the casing) is shaped to be substantially rectangular and long in the left-right direction in front elevation. As easily understood from FIG. 1C, in the front surface 31, vicinity surfaces 33 in the vicinity of the respective ends in the longitudinal direction of the front surface 31 of the front grill 6 (i.e., in the vicinity of the respective ends in the longitudinal direction of the front surface of the casing) are curved so that the size in the front-back direction (i.e., thickness) of the indoor unit 1 increases toward the central part in the longitudinal direction. These vicinity surfaces 33 are inclined (curved) to the back surface 1*b* side in the downward direction. This front surface 31 includes, apart from the vicinity surfaces 33 above, components such as the front end 30F of the top plate portion 30, openings 34 for taking in the room air, and an outlet port peripheral portion 35 provided around the outlet port 27.

Figure 11:
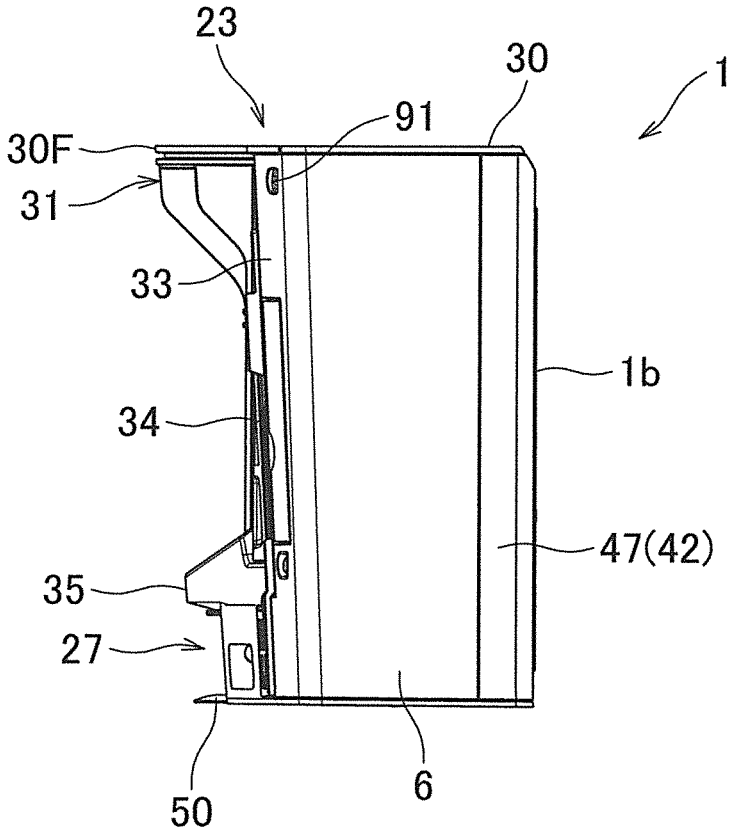
FIG. 11 is a right side view of the indoor unit from which the front panel and the outlet panel have been detached.

As shown in FIG. 4, the openings 34 are formed from around the center in the up-down direction of the front surface 31 to an upper part of the front surface 31, so as to oppose the front surface side of the indoor heat exchanger 20. Each opening 34 is rectangular in shape and long in the left-right direction, and extends in the vertical direction as shown in FIG. 11. The openings 34 are therefore in the same plane. Through these openings 34, the room air taken in from the front end 24F side of the opening 24 and the room air taken in through a later-described second inlet port 26 are sent to the fan 21 side. In front of these openings 34, a filter 36 (see FIG. 5) is attached to cover the substantially entirety of the openings 34. As shown in FIG. 5, this filter 36 extends from the front side to the upper side of the indoor heat exchanger 20, in order to capture dust in the room air which is taken in through the first inlet port 23 and the second inlet port 26.

Figure 1A:
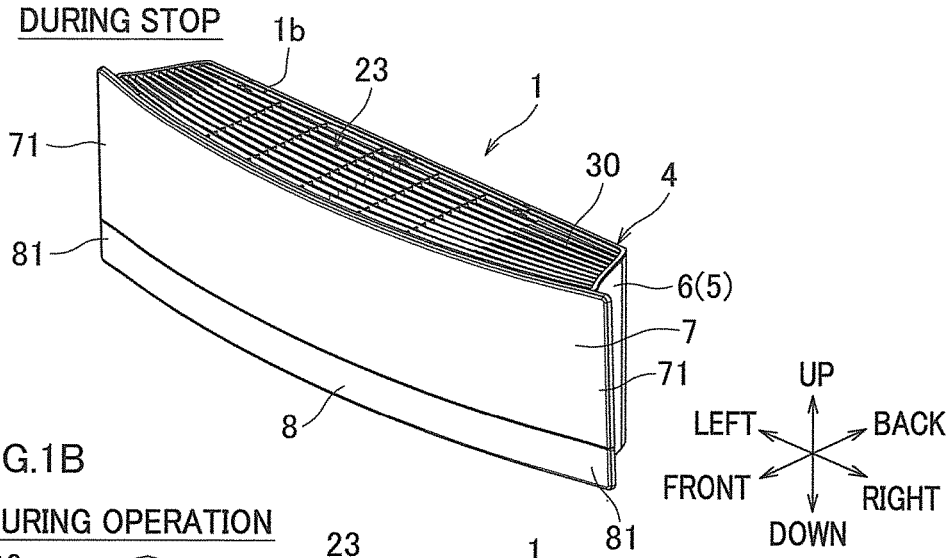
FIG. 1A is an oblique perspective of an indoor unit of an embodiment of the present invention during operation stop.
Figure 1B:
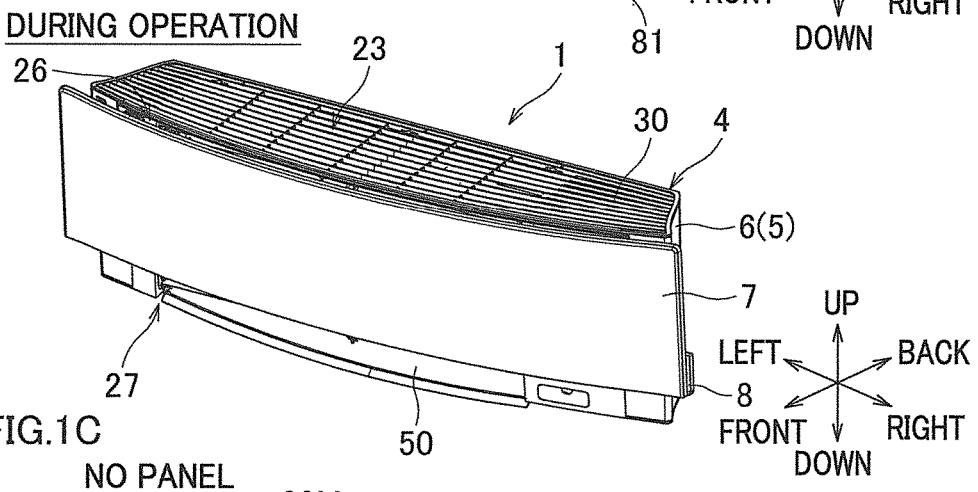
FIG. 1B is an oblique perspective of the indoor unit during operation.
Figure 1C:
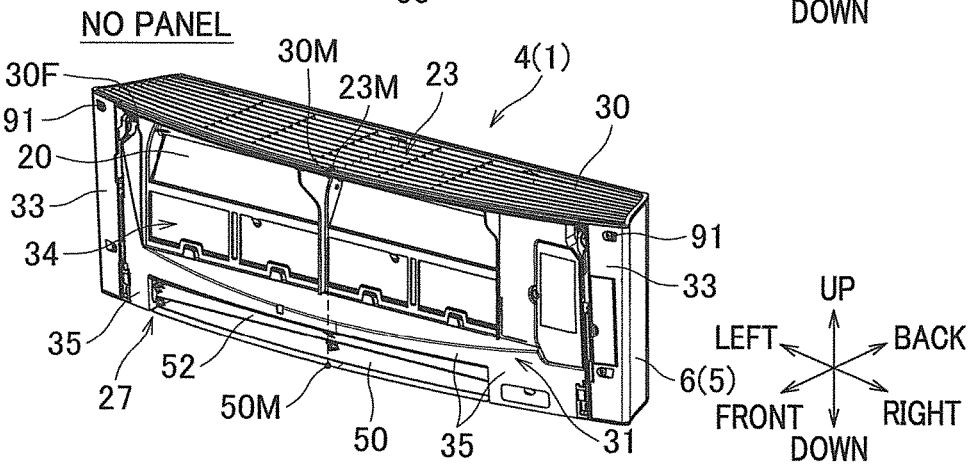
FIG. 1C is an oblique perspective of the indoor unit from which a front panel and an outlet panel have been detached.

As shown in FIG. 1C, the outlet port peripheral portion 35 is curved so that its central part in the longitudinal direction protrudes forward. To be more specific, the outlet port peripheral portion 35 is curved so that the thickness in the front-back direction of the indoor unit 1 increases from the both ends toward the central part in the longitudinal direction.

As understood from figures such as FIG. 1A, during operation stop of the indoor unit 1, the front panel 7 is in contact with or close to the front end 30F and a part of (upper side of) the vicinity surfaces 33 of the top plate portion 30. The upper part of the front surface 31 is therefore closed by the front panel 7. In addition to the above, the outlet panel 8 is in contact with or close to the outlet port peripheral portion 35 and a part of (lower side of) the vicinity surfaces 33. The lower part of the front surface 31 is therefore closed by the outlet panel 8. In the meanwhile, during operation of the indoor unit 1, as shown in FIG. 1B, a gap is formed between the front panel 7 and the front end 30F of the top plate portion 30 and the vicinity surfaces 33, as the front panel 7 moves substantially horizontally forward, with the result that the second inlet port 26 for sucking the room air is formed. Furthermore, as the outlet panel 8 is moved to a position between the front panel 7 and the front grill 6, the outlet port 27 is opened.

As shown in FIG. 4, on the upper end side of the vicinity surfaces 33 provided in the vicinity of the respective ends in the longitudinal direction of the front surface 31, two recesses 91 are formed to recess toward the back surface as compared to the vicinity surfaces 33 (i.e., the front surface 31 of the front grill 6). These recesses 91 are symmetrically formed in the left-right direction. As shown in FIG. 12, in each of these recesses 91, a screw fixing portion 92 (screw hole) is formed to receive a screw S for fixing the front grill 6 to the bottom frame 42. Furthermore, on each recess 91, a protrusion 93 is provided outside in the left-right direction of the screw fixing portion 92 to protrude forward as compared to the vicinity surface 33 (front surface of the front grill). With this arrangement, in this indoor unit 1, the screw S is less visible in a side view and an oblique front view of the indoor unit 1.

Figure 8:
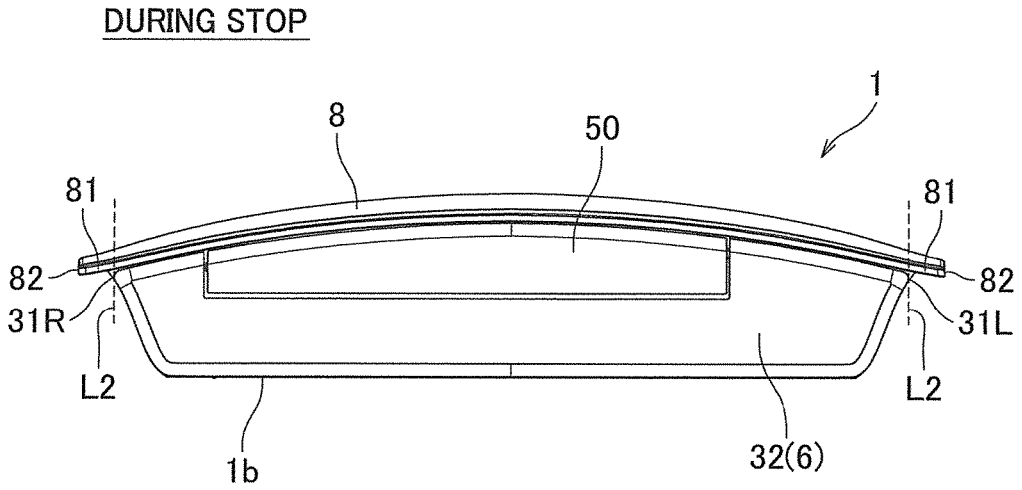
FIG. 8 is a bottom view of the indoor unit during operation stop.

Below the front surface 31 and in front of the bottom surface 32, an opening is formed to form the outlet port 27 together with the bottom frame 42. The front surface of this outlet port 27 is closed by the outlet panel 8 during operation stop of the indoor unit 1. The bottom surface of this outlet port 27 is, as shown in FIG. 8, closed by the wind direction changing plate 50 attached to the bottom frame 42, during operation stop of the indoor unit 1.

As shown in FIG. 2B, in the outlet port 27, the wind direction changing plate 50 and the auxiliary wind direction changing plate 52 above the wind direction changing plate 50 are provided. Each of the wind direction changing plate 50 and the auxiliary wind direction changing plate 52 is a plate which is long in the left-right direction. The wind direction changing plate 50 and the auxiliary wind direction changing plate 52 are arranged to be rotatable about different rotational axes extending along the horizontal direction, respectively. With this arrangement, the wind direction changing plate 50 changes, in the up-down direction, the direction of the air blown out from the outlet port 27, together with the auxiliary wind direction changing plate 52. The wind direction changing plate 50 is connected with the flap motor 51, whereas the auxiliary wind direction changing plate 52 is connected with the auxiliary flap motor 53. The wind direction changing plate 50 and the auxiliary wind direction changing plate 52 are rotatable about different rotational axes extending along the horizontal direction, respectively, by the driving of the flap motor 51 and the auxiliary flap motor 53.

Figure 9B:
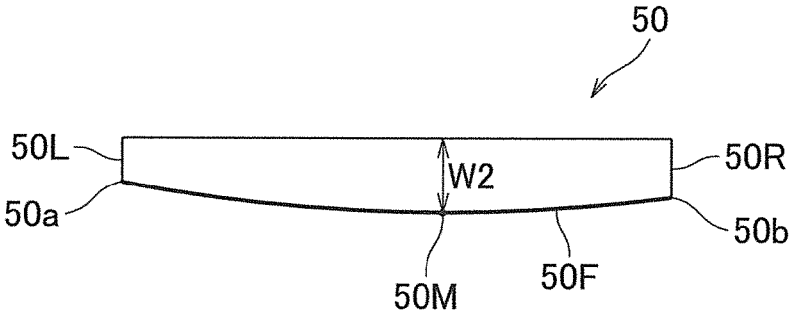
FIG. 9B is a front elevation of only a wind direction changing plate.

As shown in FIG. 9B and FIG. 10, the wind direction changing plate 50 is curved so that the center and its surroundings of the front end 50F of the wind direction changing plate 50 protrudes forward. To be more specific, the front end 50F of the wind direction changing plate 50 is inclined to the back surface 1*b* side from an outlet central part 50M (see also FIG. 1C and FIG. 2B) corresponding to the central part 30M of the front end 30F of the top plate portion 30 toward the both ends 50*a* and 50*b*, and is curved so that the direction of a tangent to the front end 50F of the top plate portion 50 continuously changes in plan view. Side ends 50L and 50R of the wind direction changing plate 50 extend in the front-back direction. This wind direction changing plate 50 is arranged such that the width W2 of the outlet central part 50M corresponding to the central part 30M of the front end 30F of the top plate portion 30 is wider than the width in the longitudinal direction of each of the both ends of the wind direction changing plate 50 (i.e., wider than each of the width of the left end 50L and the width of the right end 50R). The width of the wind direction changing plate 50 is maximum at the outlet central part 50M. The width of the wind direction changing plate 50 is narrowed from the outlet central part 50M toward the ends 50*a* and 50*b* in the longitudinal direction of the wind direction changing plate 50. As shown in FIG. 8, this wind direction changing plate 50 is shaped to extend along an opening defined by the outlet panel 8 and the bottom surface 32 of the front grill 6 during operation stop of the indoor unit 1. When an instruction to stop the operation is received, the wind direction changing plate 50 moves to be in parallel to the horizontal plane, so as to form the bottom surface of the indoor unit 1, which is in parallel to the horizontal plane, together with the bottom surface 32 of the front grill 6. As shown in FIG. 10, the central part in the longitudinal direction of the wind direction changing plate 50 is slightly shifted leftward from the outlet central part 50M corresponding to the central part 30M of the front end 30F of the top plate portion 30, and corresponds to the central part in the longitudinal direction of the fan 21 and the central part in the longitudinal direction of the opening 24. The width W3 of the central part in the longitudinal direction of the wind direction changing plate 50 is wider than the width of each of the ends in the longitudinal direction (i.e., the width of the left end 50L and the width of the right end 50R) of the wind direction changing plate 50.

In the meanwhile, as shown in FIG. 2B, the width of the auxiliary wind direction changing plate 52 is uniform in the longitudinal direction. As such, because the width of the auxiliary wind direction changing plate 52 is uniform in the longitudinal direction, the wind direction changing plate 50 and the auxiliary wind direction changing plate 52 do not interfere with each other when the wind direction changing plate 50 and the auxiliary wind direction changing plate 52 rotate about the different rotational axes extending along the horizontal direction.

[Front Panel and Outlet Panel]

As shown in FIG. 1A, the front panel 7 and the outlet panel 8 substantially cover the entirety of the front surface 31 of the front grill 6 during operation stop of the indoor unit 1.

The front panel 7 is formed by molding a resin material, and covers an upper part of the front surface 31 of the front grill 6. The front panel 7 is supported at around the left and right ends by a later-described opening mechanism 61 to be movable in the front-back direction. The second inlet port 26 is opened as the front panel 7 moves away from the front surface 31 of the front grill 6, and the second inlet port 26 is closed as the front panel 7 moves toward the front surface 31 of the front grill 6.

The outlet panel 8 is formed by molding a resin material and covers a lower part of the front surface 31 of the front grill 6. The outlet panel 8 is supported at around the left and right ends by the later-described opening mechanism 61 to be movable in the up-down direction. The outlet port 27 is opened as the outlet panel 8 moves to the gap between the front panel 7 and the front grill 6 (i.e., moves upward) in a state that the front panel 7 has moved forward, and the outlet port 27 is closed as the outlet panel 8 moves downward.

(Panel Shape)

Each of the front panel 7 and the outlet panel 8 is a three-dimensional panel having a three-dimensional shape. In other words, each of these panels is curved in the longitudinal direction (left-right direction) and in the up-down direction. The thickness of the front panel 7 and the thickness of the outlet panel 8 are substantially constant in the longitudinal direction and the up-down direction, and are substantially identical with each other. From the substantially entire outer circumference of the back surfaces of the front panel 7 and the outlet panel 8, reinforcing ribs 7*a* and 8*a* protrude backward (see FIG. 13D).

Figure 13A:
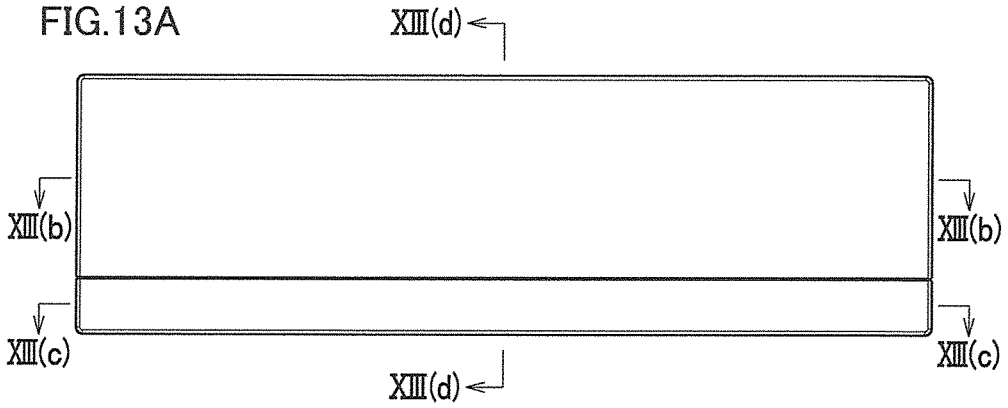
FIG. 13A is a front elevation of the front panel and the outlet panel.
Figure 13B:
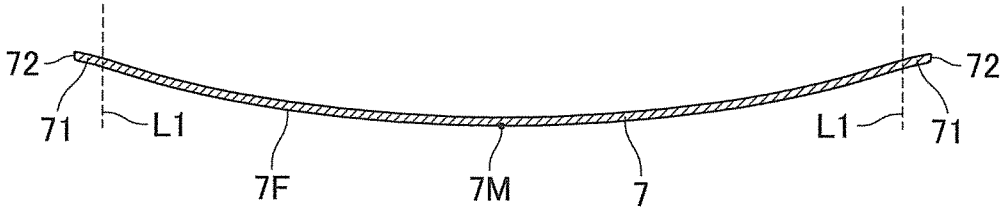
FIG. 13B is a cross section taken at the XIII(b)-XIII(b) line.

As shown in FIG. 13B, the front panel 7 is curved so that its central part 7M protrudes forward in plan view. To be more specific, the front surface 7F (front surface portion) of the front panel 7 is inclined to the back surface 1*b* side from the central part 7M of the front surface 7F of the front panel 7 toward the ends in the longitudinal direction, and the direction of a tangent to the front surface 7F of the front panel 7 continuously changes in plan view. In other words, the front panel 7 is entirely curved in the longitudinal direction.

Figure 13C:
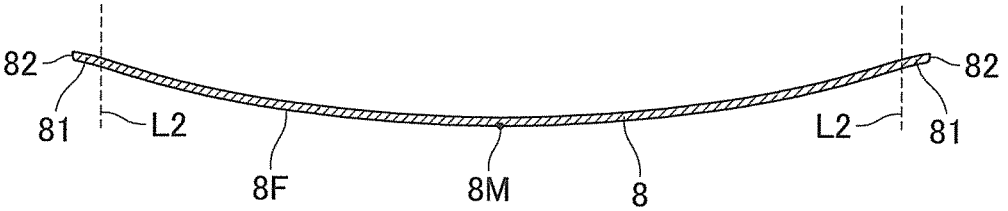
FIG. 13C is a cross section taken at the XIII(c)-XIII(c) line.
Figure 13D:
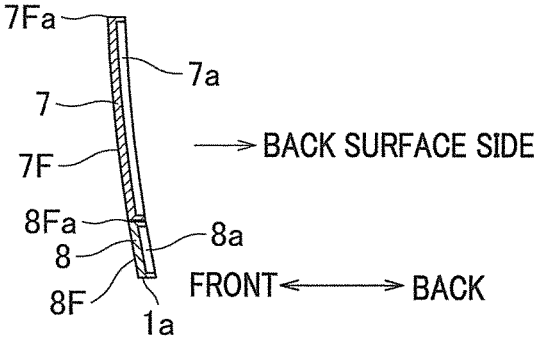
FIG. 13D is a cross section taken at the XIII(d)-XIII(d) line.

As shown in FIG. 13D, this front panel 7 is arranged such that the upper end 7Fa of the front surface 7F of the front panel 7 is at the forefront, and the front surface 7F (front surface portion) of the front panel 7 is inclined to the back surface 1*b* side toward the lower end 1*a*. Furthermore, because the thickness of the front panel 7 is constant in the up-down direction, the entirety of the front panel 7 is inclined to the back surface 1*b* side toward the lower end 1*a*. Furthermore, this front panel 7 is curved so that the front side thereof protrudes, i.e., the direction of a tangent to the front surface 7F of the front panel 7 continuously changes in cross section. In other words, the front panel 7 is entirely curved in the left-right direction.

In this front panel 7, a part opposing the front end 30F of the top plate portion 30 of the front grill 6 is curved along the front end 30F. Furthermore, in the front panel 7, parts opposing the vicinity surfaces 33 of the front grill 6 are curved along the vicinity surfaces 33 in the longitudinal direction and in the up-down direction. On this account, gaps are scarcely formed between the front panel 7 and the front end 30F and the vicinity surfaces 33 during operation stop of the indoor unit 1.

As shown in FIG. 13C, the outlet panel 8 is curved so that its central part 8M protrudes forward in plan view. To be more specific, the front surface 8F of the outlet panel 8 is inclined to the back surface 1*b* side from the central part 8M of the front surface 8F of the outlet panel 8 toward the ends in the longitudinal direction, and the direction of a tangent to the front surface 8F of the outlet panel 8 continuously changes in plan view. In other words, the outlet panel 8 is entirely curved in the longitudinal direction.

As shown in FIG. 13D, this outlet panel 8 is arranged such that the upper end 8Fa of the front surface 8F of the outlet panel 8 is at the forefront, and the front surface 8F of the outlet panel 8 is inclined to the back surface 1*b* side toward the lower end 1*a*. Furthermore, because the thickness of the outlet panel 8 is constant in the up-down direction, the entirety of the front panel 8 is inclined to the back surface 1*b* side toward the lower end 1*a*. Furthermore, this outlet panel 8 is curved so that the front side thereof protrudes, i.e., the direction of a tangent to the front surface 8F of the outlet panel 8 continuously changes in cross section. In other words, the outlet panel 8 is entirely curved in the up-down direction.

In this outlet panel 8, parts opposing the vicinity surfaces 33 of the front grill 6 and a part opposing the outlet port peripheral portion 35 of the front grill 6 are curved along the vicinity surfaces 33 and the outlet port peripheral portion 35 in the longitudinal direction and the up-down direction. On this account, gaps are scarcely formed between the outlet panel 8 and the vicinity surfaces 33 and the outlet port peripheral portion 35 during operation stop of the indoor unit 1.

(Extension Parts)

As shown in FIGS. 1A and 7A, the front panel 7 includes extension parts 71 which extend outward as compared to the ends 31L and 31R of the front surface 31 of the front grill 6 (see further FIG. 4). As shown in FIGS. 1A and 8, the outlet panel 8 includes extension parts 81 which extend outward as compared to the ends 31L and 31R of the front surface 31 of the front grill 6. As shown in FIG. 7A, the extension parts 71 are parts on the outside in the longitudinal direction of lines L1 which extend along the front-back direction and pass the ends 31L and 31R of the front surface 31 of the front grill 6. As shown in FIG. 8, the extension parts 81 are parts on the outside in the longitudinal direction of lines L2 which extend along the front-back direction and pass the ends 31L and 31R of the front surface 31 of the front grill 6. The extension parts 71 are symmetrical in the left-right direction, and the extension parts 81 are symmetrical in the left-right direction, too.

As shown in FIGS. 7A and 8, the extension parts 71 of the front panel 7 and the extension parts 81 of the outlet panel 8 extend toward the back surface 1*b* side from the ends 31L and 31R of the front surface 31 of the front grill 6. Leading end portions 72 of the extension parts 71 and leading end portions 82 of the extension parts 81 are bent forward. In this regard, it is noted that "bending" encompasses "curving" in the present invention.

Figure 14:
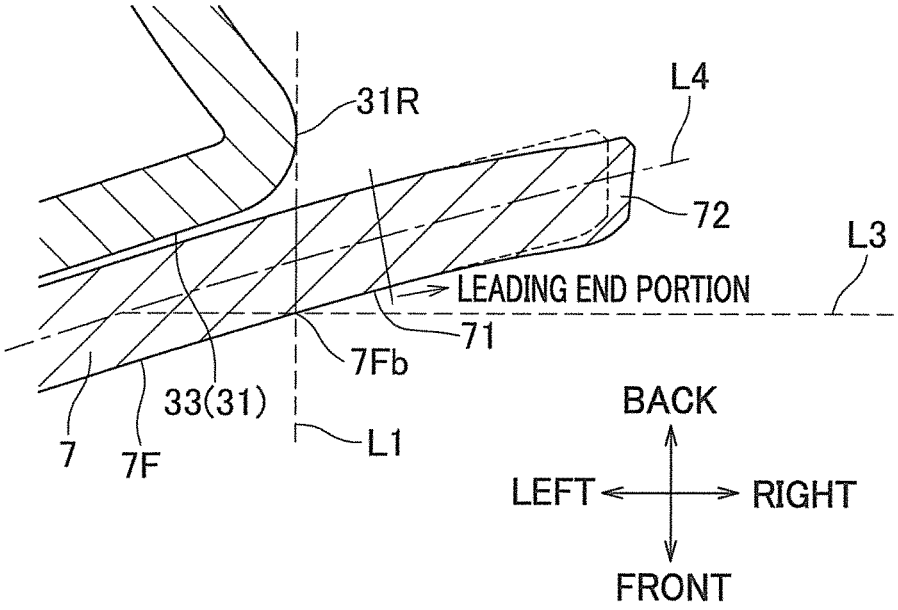
FIG. 14 is a cross section taken at the XIV-XIV line in FIG. 2.

Now, referring to FIG. 14, the definition of "the extension parts 71 extend toward the back surface 1*b* side from the ends 31L and 31R of the front surface 31 of the front grill 6" and the definition of "the leading end portions 72 of the extension parts 71 are bent forward" will be specifically described. It is noted that the definition of "the extension parts 81 extend toward the back surface 1*b* side from the ends 31L and 31R of the front surface 31 of the front grill 6" and the definition of "the leading end portions 82 of the extension parts 81 are bent forward" are not described because they are similar to the above.

The recitation "the extension parts 71 extend toward the back surface 1*b* side from the ends 31L and 31R of the front surface 31 of the front grill 6" indicates that, as shown in FIG. 14, the entirety of each extension part 71 is on the back surface 1*b* side relative to a horizontal line L3 (in the left-right direction) which passes an intersection 7Fb of the above-described line L1 and the front surface 7F of the front panel 7. The recitation "the leading end portions 72 of the extension parts 71 are bent forward" indicates that, in plan view, at least a part of the center line of each leading end portion 72 is on the front side of a virtual line L4 which is an outward extension in the left-right direction of the center line of the front panel 7 except the leading end portion 72 of the extension part 71.

[Drive Mechanism]

The drive mechanism 9 is a mechanism for moving the front panel 7 away from the front surface 31 of the front grill 6 in a substantially horizontal direction and moving the outlet panel 8 to the gap between the front panel 7 and the front grill 6 in a state that the front panel 7 has moved forward in the substantially horizontal direction. As shown in FIG. 4, the drive mechanism 9 is provided with a driver 41 and an opening mechanism 61.

As shown in FIG. 4, the driver 41 is to the left of the indoor heat exchanger 20 and the fan 21 in front elevation, and is configured to generate driving force for moving the front panel 7 and the outlet panel 8. This driver 41 includes the drive motor 43 (see FIG. 6) and unillustrated driver gears. The drive motor 43 is connected by a cable with the controller 60 housed in the electric component box 40, and functions as a drive source for moving the front panel 7 and the outlet panel 8. The driver gears are disposed to be engaged with an unillustrated power transmission gear of the opening mechanism 61. The driver gears transmit the rotation of the drive motor 43, i.e., the driving force of the drive motor 43 to the power transmission gear of the opening mechanism 61.

The opening mechanism 61 is a mechanism for opening and closing the second inlet port 26 and the outlet port 27 by moving the front panel 7 and the outlet panel 8 by means of the driving force of the driver 41. The opening mechanism 61 is formed of components including gears, and functions as a speed reducer for transmitting the driving force of the driver 41 to the front panel 7 and the outlet panel 8. The opening mechanism 61 functions as a conversion mechanism of converting the rotational movement transmitted from the driver 41 to the opening/closing movement of the front panel 7 and the outlet panel 8. As shown in FIG. 4, the opening mechanism 61 includes a first opening mechanism 62 provided to the left of the front grill 6 and a second opening mechanism 63 provided to the right of the front grill 6. The first opening mechanism 62 and the second opening mechanism 63 are connected with each other by an unillustrated power transmission shaft.

The first opening mechanism 62 is attached to the back surfaces of the left side surfaces of the front panel 7 and the outlet panel 8, to support the left ends and their surroundings of the front panel 7 and the outlet panel 8. The first opening mechanism 62 transfers the driving force of the driver 41 to the left end and its surroundings of the front panel 7 and to the left end and its surroundings of the outlet panel 8, so as to move the left parts of the front panel 7 and the outlet panel 8, when the front panel 7 and the outlet panel 8 are opened or closed.

The second opening mechanism 63 is attached to the back surfaces of the right side surfaces of the front panel 7 and the outlet panel 8, to support the right ends and their surroundings of the front panel 7 and the outlet panel 8. The second opening mechanism 63 transfers the driving force of the driver 41 to the right end and its surroundings of the front panel 7 and to the right end and its surroundings of the outlet panel 8, so as to move the right parts of the front panel 7 and the outlet panel 8, when the front panel 7 and the outlet panel 8 are opened or closed.

The unillustrated power transmission shaft is a member which distributes and transfers the driving power of the driver 41 to the first opening mechanism 62 and the second opening mechanism 63, and is attached to the back surface of the front surface 31 of the front grill 6 to be rotatable about an axis which is in parallel to the longitudinal direction of the indoor unit 1. The ends of the power transmission shaft are connected with the first opening mechanism 62 and the second opening mechanism 63, respectively, and unillustrated power transmission gears are provided therebetween. The power transmission gear is disposed to be engaged with the driver gears of the driver 41. As such, the opening mechanism 61 is configured to distribute, by the power transmission shaft, the driving force from the driver 41 to the first opening mechanism 62 and the second opening mechanism 63.

Figure 15:
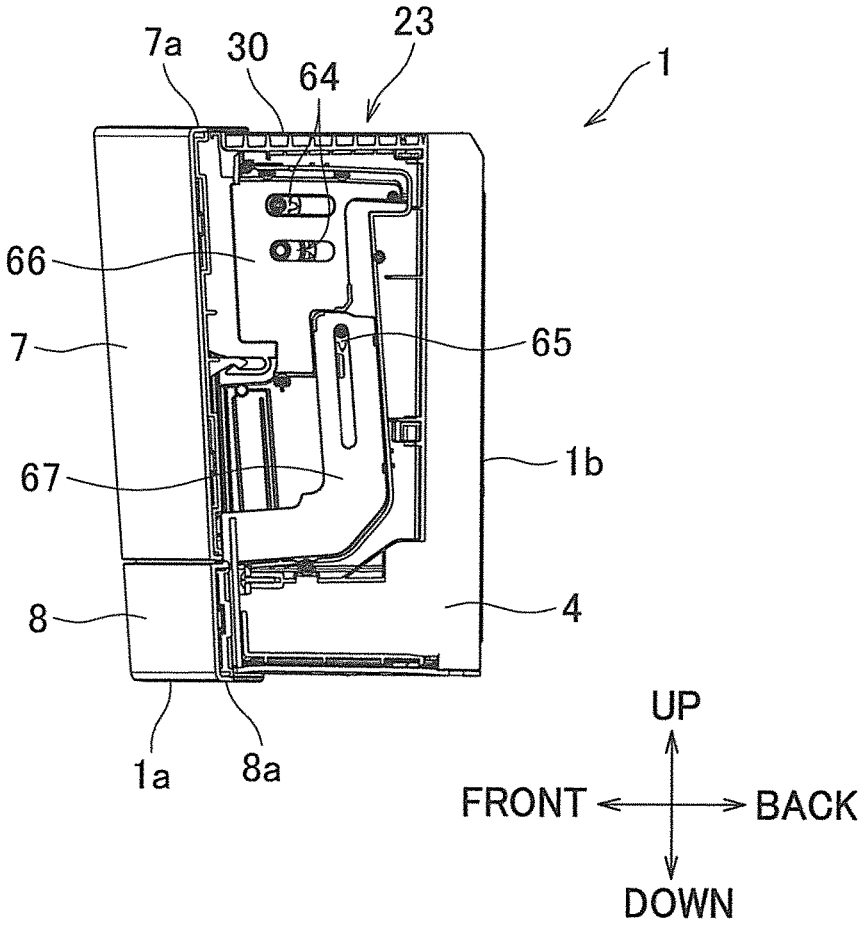
FIG. 15 is a cross section taken at the XV-XV line in FIG. 2 and shows the structure of a drive mechanism.

The following will briefly describe the arrangement of the first opening mechanism 62. The description of the second opening mechanism 63 is omitted because it is symmetrical in structure with the first opening mechanism 62 in the left-right direction. The first opening mechanism 62 includes, as shown in FIG. 15, front panel opening gears 64, an outlet panel opening gear 65, a front panel supporting member 66, an outlet panel supporting member 67, and a transmission gear 68.

The front panel opening gear 64 transmits, to the front panel supporting member 66, the driving force supplied from the driver 41 via the power transmission shaft. This front panel supporting member 66 is provided to be movable in the front-back direction (substantially horizontal direction), and is able to linearly move the front panel 7 in the front-back direction.

The transmission gear 68 transmits, to the outlet panel opening gear 65, the driving force supplied from the driver 41 via the power transmission shaft, and the outlet panel opening gear 65 transmits the driving force to the outlet panel supporting member 67. This outlet panel supporting member 67 is provided to be movable in the up-down direction, and is able to linearly move the outlet panel 8 in the up-down direction. The transmission gear 68 has a part where no tooth is formed. With this, until the driver 41 is driven and the forward movement of the front panel supporting member 66 is completed, the rotation of the transmission gear 68 is not transmitted to the outlet panel opening gear 65. After the completion of the forward movement of the front panel supporting member 66, the transmission gear 68 is engaged with the outlet panel opening gear 65, and hence the upward movement of the outlet panel supporting member 67 becomes possible.

[Movement of Front Panel and Outlet Panel at Driving Start]

Now, the movement of the front panel 7 and the outlet panel 8 at the start of the driving will be described with reference to FIG. 16.

Figure 16A:
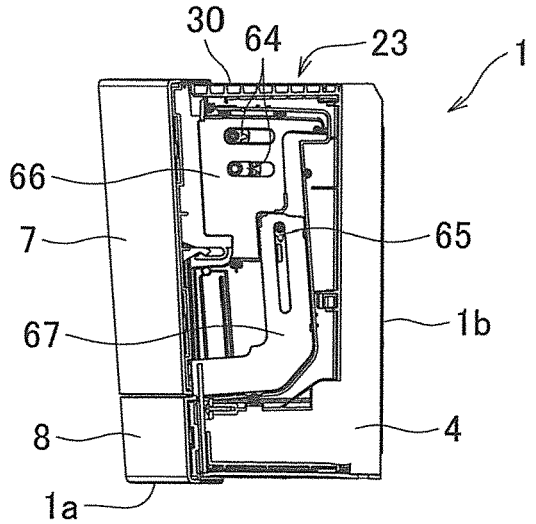
FIGS. 16A to 16C illustrate how the front panel and the outlet panel move.

As shown in FIG. 16A, when the indoor unit 1 is in a stopped state, the second inlet port 26 and the outlet port 27 are closed by the front panel 7 and the outlet panel 8. When the indoor unit 1 is in the stopped state, the front surface 7F of the front panel 7 and the front surface 8F of the outlet panel 8 are substantially flush with each other in the up-down direction in a side view. In this state, the front panel supporting member 66 of the opening mechanism 61 is at the most backward position within the movable range. The outlet panel supporting member 67 is at the lowermost position within the movable range.

As the indoor unit 1 starts the operation, the drive motor 43 of the driver 41 is controlled and starts the rotation. The driving force of the driver 41 is transmitted to the unillustrated power transmission shaft of the opening mechanism 61, and the driving force is distributed to the first opening mechanism 62 and the second opening mechanism 63 of the opening mechanism 61. Thereafter, by the first opening mechanism 62 and the second opening mechanism 63, the front panel 7 and the outlet panel 8 are moved, with the result that the second inlet port 26 and the outlet port 27 are opened.

To be more specific, by the opening mechanism 61, the driving force of the driver 41 is transmitted to the front panel supporting member 66 via the front panel opening gears 64. As a result, the front panel supporting member 66 linearly moves forward in the substantially horizontal direction. With this, as shown in FIG. 16B, the front panel 7 moves forward in the substantially horizontal direction so as to open the second inlet port 26.

Figure 16B:
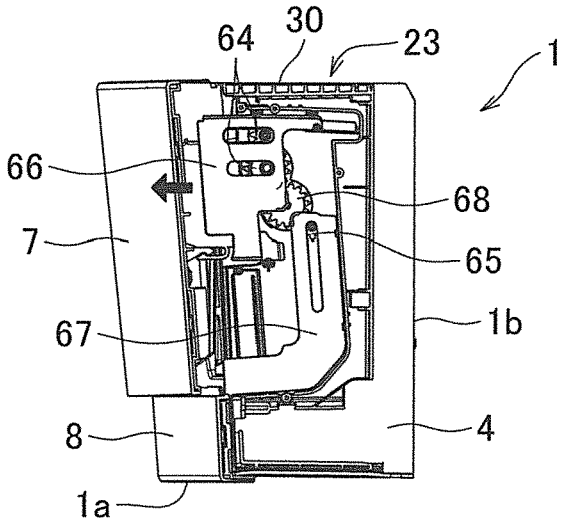
Figure 16C:
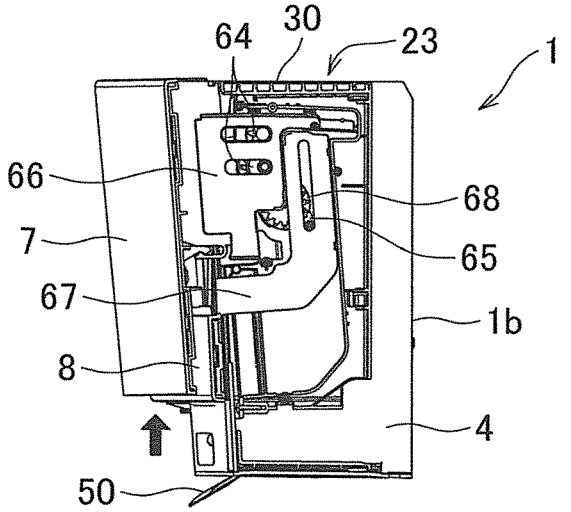

As shown in FIG. 16B, when the front panel supporting member 66 is at the most forward position within the movable range, the driving force of the driver 41 is transmitted to the outlet panel supporting member 67 via the transmission gear 68 and the outlet panel opening gear 65. With this, as shown in FIG. 16C, the outlet panel 8 moves to the gap between the front panel 7 and the front grill 6, so as to open the outlet port 27. When the outlet panel supporting member 67 is at the uppermost position within the movable range, the outlet panel 8 is hidden behind the front panel 7. In other words, the substantially entirety of the outlet panel 8 overlaps the front panel 7, and hence the outlet panel 8 is not viewable in front elevation as shown in FIG. 2A.

As the fan 21 is driven, the room air is sucked into the indoor unit 1 through the first inlet port 23 and the second inlet port 26 and is subjected to heat exchange at the indoor heat exchanger 20, and the air after the heat exchange is blown out from the outlet port 27.

During operation stop of the indoor unit 1, the drive motor 43 of the driver 41 is controlled to drive backward, and the outlet panel supporting member 67 and the front panel supporting member 66 move in this order in the direction opposite to the above. As a result, the front panel 7 and the outlet panel 8 move inversely as compared to the above, and the front panel 7 and the outlet panel 8 return to the state of the stop of the indoor unit 1.

<Characteristics of Indoor Unit of Present Embodiment>

In the indoor unit 1 of the present embodiment, the front panel 7 merely moves in the substantially horizontal direction and the inclination of the front panel 7 does not become great. For this reason, even if the front panel 7 moves away from the front surface of the casing 5 during operation, the downward force acting on the central part of the front panel 7 does not increase as compared to the downward force during operation stop, and hence the warping of the central part of the front panel 7 during operation is restrained.

In addition to the above, in the indoor unit 1 of the present embodiment, because the outlet panel 8 is moved to the gap between the front panel 7 and the casing 5 in the state that the front panel 7 has moved forward, it is possible to close the gap between the lower end portion of the front panel 7 and the casing 5. This restrains the air blown out from the outlet port 27 from being sucked into the gap between the front panel 7 and the casing 5.

In addition to the above, in the indoor unit 1 of the present embodiment, as the front panel 7 is inclined to the back surface side toward the lower end, the thickness of the bottom surface part of the indoor unit 1 is thinner than the thickness of the top plate portion 30 of the indoor unit 1, and hence the indoor unit 1 looks thin when a user sees the indoor unit 1 from below.

In addition to the above, because, in the indoor unit 1 of the present embodiment, the width of the inlet central part 23M of the first inlet port 23 is wider than the width of each of the ends in the longitudinal direction of the first inlet port 23, air volume is increased at around the central part of the cross flow fan 21.

Thus, the embodiment of the present invention is described hereinabove. However, the specific structure of the present invention shall not be interpreted as to be limited to the above described embodiment. The scope of the present invention is defined not by the above embodiment but by claims set forth below, and shall encompass the equivalents in the meaning of the claims and every modification within the scope of the claims.

While the embodiment above describes a case where the outlet panel 8 is provided forward of the inlet port 27 and the outlet panel 8 is moved to the gap between the front panel 7 and the casing 5, the outlet panel 8 does not have to be provided, or the outlet panel 8 is provided but may not move to the gap between the front panel 8 and the casing 5.

While in the embodiment above the front surface of the front panel 7 is inclined to the back surface side toward the lower end, the front surface of the front panel 7 may extend along the vertical direction (i.e., not inclined), or the front surface of the front panel 7 may be inclined forward toward the lower end.

The embodiment above describes that the central part of the front end 30F of the top plate portion 30 is curved to protrude forward and the first inlet port 23 is arranged such that the width of the inlet central part 23M corresponding to the central part of the front end 30F of the top plate portion 30 is wider than the width of each of the ends in the longitudinal direction of the first inlet port 23. In this regard, the central part of the front end 30F of the top plate portion 30 may not be curved to protrude forward, and the width of the inlet central part 23M of the first inlet port 23 corresponding to the central part of the front end 30F of the top plate portion 30 may not be wider than the width of each of the ends in the longitudinal direction of the first inlet port 23.

While in the embodiment above the front panel 7 is a three-dimensional panel which is entirely curved in the longitudinal direction and entirely curved in the up-down direction, the front panel 7 may be a three-dimensional panel at least partially curved in the longitudinal direction and at least partially curved in the up-down direction, on condition that the central part 7M of the front panel 7 is curved to protrude forward in plan view. Furthermore, on condition that the central part 7M of the front panel 7 is curved to protrude forward, the front panel 7 may be a two-dimensional panel which is at least partially curved in the longitudinal direction but is not curved in the up-down direction.

While in the embodiment above the outlet panel 8 is a three-dimensional panel which is entirely curved in the longitudinal direction and entirely curved in the up-down direction, the outlet panel 8 may be a three-dimensional panel at least partially curved in the longitudinal direction and at least partially curved in the up-down direction, on condition that the central part 8M of the outlet panel 8 is curved to protrude forward in plan view. Furthermore, on condition that the central part 8M of the outlet panel 8 is curved to protrude forward, the outlet panel 8 may be a two-dimensional panel which is at least partially curved in the longitudinal direction but is not curved in the up-down direction.

INDUSTRIAL APPLICABILITY

According to the present invention, it is possible to restrain a central part of a front panel from being warped when the front panel moves away from a front surface of a casing.

REFERENCE SIGNS LIST

1 INDOOR UNIT
5 CASING
6 FRONT GRILL
7 FRONT PANEL
8 OUTLET PANEL
9 DRIVE MECHANISM
21 CROSS FLOW FAN
23 FIRST INLET PORT (INLET PORT)
23M INLET CENTRAL PART OF FIRST INLET PORT
27 OUTLET PORT
30 TOP PLATE PORTION
30F FRONT END OF TOP PLATE PORTION

The invention claimed is:

1. An indoor unit comprising:

a casing;

a front panel provided forward of the casing; and a drive mechanism configured to move the front panel away from a front surface of the casing, the front panel being curved so that a central part of the front panel protrudes forward, the casing including an outlet port provided below the front panel, an outlet panel being provided below the front panel and forward of the outlet port, the drive mechanism moving the front panel in a substantially horizontal direction and moving the outlet panel to a gap between the front panel and the casing in a state that the front panel has been moved forward, and when the outlet panel is moved to the gap between the front panel and the casing, a gap between a lower end portion of the front panel and the casing is closed by the outlet panel, wherein, the casing includes a top plate portion where an inlet port is formed and houses a cross flow fan, the top plate portion is curved so that a central part of a front end of the top plate portion protrudes forward, and the width of an inlet central part of the inlet port corresponding to the central part of the front end of the top plate portion is wider than the width of each of ends in a longitudinal direction of the inlet port.

2. An indoor unit comprising:

a casing;

a front panel provided forward of the casing; and a drive mechanism configured to move the front panel away from a front surface of the casing, the front panel being curved so that a central part of the front panel protrudes forward, the casing including an outlet port provided below the front panel, an outlet panel being provided below the front panel and forward of the outlet port, the drive mechanism moving the front panel in a substantially horizontal direction and moving the outlet panel to a gap between the front panel and the casing in a state that the front panel has been moved forward, and when the outlet panel is moved to the gap between the front panel and the casing, a gap between a lower end portion of the front panel and the casing is closed by the outlet panel, wherein, the front panel is inclined toward a back surface in a direction to a lower end, the casing includes a top plate portion where an inlet port is formed and houses a cross flow fan, the top plate portion is curved so that a central part of a front end of the top plate portion protrudes forward, and the width of an inlet central part of the inlet port corresponding to the central part of the front end of the top plate portion is wider than the width of each of ends in a longitudinal direction of the inlet port.

* * * * *